US009587467B2

(12) United States Patent
Vu et al.

(10) Patent No.: US 9,587,467 B2
(45) Date of Patent: Mar. 7, 2017

(54) CONTAINMENT SYSTEM AND A METHOD FOR USING SAID CONTAINMENT SYSTEM

(71) Applicant: TOTAL SA, Courbevoie (FR)

(72) Inventors: Van-Khoi Vu, Pau (FR); Jean-Claude Bourguignon, Pau (FR)

(73) Assignee: TOTAL SA, Courbevoie (FR)

( * ) Notice: Subject to any disclaimer, the term of this patent is extended or adjusted under 35 U.S.C. 154(b) by 0 days.

(21) Appl. No.: 14/433,542

(22) PCT Filed: Dec. 14, 2012

(86) PCT No.: PCT/EP2012/075675

§ 371 (c)(1),
(2) Date: Apr. 3, 2015

(87) PCT Pub. No.: WO2014/053199

PCT Pub. Date: Apr. 10, 2014

(65) Prior Publication Data

US 2015/0260018 A1 Sep. 17, 2015

Related U.S. Application Data

(60) Provisional application No. 61/710,333, filed on Oct. 5, 2012.

(51) Int. Cl.
*E21B 43/01* (2006.01)
*E21B 43/36* (2006.01)
(Continued)

(52) U.S. Cl.
CPC ..... *E21B 43/0122* (2013.01); *E02B 15/04* (2013.01); *E02B 15/0814* (2013.01);
(Continued)

(58) Field of Classification Search
CPC .... E02B 2015/005; E02B 15/04; E02B 15/08; E02B 15/0814; E21B 43/0122; Y10S 210/923
See application file for complete search history.

(56) References Cited

U.S. PATENT DOCUMENTS 2,532,341 A * 12/1950 Shannon ..... E21B 33/037 166/96.1
3,667,605 A 6/1972 Zielinski
(Continued)

FOREIGN PATENT DOCUMENTS

FR 2961843 12/2011
FR 2972216 9/2012
(Continued)

OTHER PUBLICATIONS

PCT International Search Report for PCT/EP2012/075675, mailed Feb. 17, 2014, 4 pgs.
(Continued)

*Primary Examiner* — Matthew R Buck
*Assistant Examiner* — Aaron Lembo
(74) *Attorney, Agent, or Firm* — Patterson Thuente Pedersen, P.A.

(57) ABSTRACT

A containment system for recovering hydrocarbon fluid from a leaking device comprising a wall extending from a base level to a first level for surrounding the leaking device, and a dome situated above the wall and forming a cavity for accumulating hydrocarbon fluid. The dome comprises an upper output opening for extracting the hydrocarbon fluid. The containment system further comprises a lower output opening extending up to a dome level. The wall and the dome are independent members so as the wall can be landed on the seafloor before the dome is installed.

27 Claims, 7 Drawing Sheets

(51) Int. Cl.
*E02B 15/04* (2006.01)
*E02B 15/08* (2006.01)
*E02B 15/00* (2006.01)

(52) U.S. Cl.
CPC ..... *E21B 43/36* (2013.01); *E02B 2015/005* (2013.01); *Y10S 210/922* (2013.01); *Y10S 210/923* (2013.01)

(56) References Cited

U.S. PATENT DOCUMENTS

| | | | |
|---|---|---|---|
| 4,395,157 | A | 7/1983 | Cunningham |
| 4,405,258 | A | 9/1983 | O'Rourke et al. |
| 4,531,860 | A | 7/1985 | Barnett |
| 5,213,444 | A | 5/1993 | Henning |
| 6,176,317 | B1 | 1/2001 | Sepich |
| 7,987,903 | B1 | 8/2011 | Garcia |
| 2011/0274493 | A1 | 11/2011 | Cutts |
| 2011/0293372 | A1 | 12/2011 | Later |
| 2011/0299929 | A1 | 12/2011 | Sabourin |
| 2011/0315233 | A1 | 12/2011 | Carter |
| 2012/0051840 | A1 | 3/2012 | Hatton |
| 2012/0087729 | A1 | 4/2012 | Oesterberg et al. |
| 2012/0118580 | A1 | 5/2012 | Swanson et al. |
| 2012/0125623 | A1 | 5/2012 | Cargol, Jr. et al. |
| 2012/0155964 | A1 | 6/2012 | Carter et al. |
| 2012/0181041 | A1 | 7/2012 | Willman |
| 2012/0186822 | A1 | 7/2012 | Mahajan et al. |
| 2012/0213588 | A1 | 8/2012 | Shifferaw |
| 2012/0241160 | A1 | 9/2012 | Spacek |
| 2012/0247781 | A1 | 10/2012 | Noble et al. |
| 2012/0251244 | A1 | 10/2012 | Toedtman |
| 2012/0325489 | A1* | 12/2012 | Beynet ..... E21B 37/06 166/353 |
| 2013/0046126 | A1 | 2/2013 | Varney et al. |
| 2013/0074757 | A1 | 3/2013 | McAlister |
| 2013/0118754 | A1 | 5/2013 | Worrall et al. |
| 2013/0183098 | A1 | 7/2013 | Halal et al. |
| 2013/0270194 | A1 | 10/2013 | Allen |
| 2014/0356068 | A1 | 12/2014 | Andritsos et al. |

FOREIGN PATENT DOCUMENTS

| | | | |
|---|---|---|---|
| GB | 2066095 | A | 7/1981 |
| GB | 2482181 | A | 1/2012 |
| WO | WO 81/00875 | A1 | 4/1981 |
| WO | WO 2011/145059 | A2 | 11/2011 |
| WO | WO 2011/158093 | A1 | 12/2011 |
| WO | WO 2014/053200 | A1 | 4/2014 |

OTHER PUBLICATIONS

PCT International Search Report for PCT/EP2012/075676, mailed Feb. 17, 2014, 4 pgs.

Application and File History for U.S. Appl. No. 14/433,557, filed Apr. 3, 2015, Inventors: Vu et al.

* cited by examiner

CONTAINMENT SYSTEM AND A METHOD FOR USING SAID CONTAINMENT SYSTEM

RELATED APPLICATIONS

The present application is a National Phase entry of PCT Application No. PCT/EP2012/075675, filed Dec. 14, 2012, which claims priority from U.S. Patent Application No. 61/710,333, filed Oct. 5, 2012, said applications being hereby incorporated by reference herein in their entirety.

FIELD OF THE INVENTION

The present invention concerns a containment system for recovering spilled oil that is leaking under water.

BACKGROUND OF THE INVENTION

The present invention concerns more precisely a containment system for recovering a hydrocarbon fluid from a leaking device that is situated at the seafloor and that is leaking the hydrocarbon fluid from a well.

Recovering oil that is leaking from an under water oil device is a great problem, especially for oil device that are installed at deep sea floor.

The explosion on the "Deepwater Horizon" platform in the Gulf of Mexico demonstrated how much such a containment system is difficult to control.

One of the main problems was the formation of hydrates that clogged the used containment system.

For example, at a depth of around 1500 meters, the sea water is cold (for example around only 5° C.) and at a high pressure. These environment conditions may transform the sea water and hydrocarbon fluid into hydrates having a quasi-solid phase and which can fill and clogged any cavity.

Hydrates inhibitors like methanol could be injected to avoid hydrate formation. But, the needed quantity of such chemical is huge and inhibitors are also pollution for the environment.

OBJECTS AND SUMMARY OF THE INVENTION

One object of the present invention is to provide a containment system that avoids the formation of hydrates inside the dome.

To this effect, the containment system of present invention is adapted to be landed at the seafloor corresponding to a base level of the containment system. It comprises at least:

- a wall extending from the base level to a first level so as to completely surround the leaking device, said wall being substantially sealed to the seafloor around said leaking device, and
- a dome situated above the wall and forming a cavity under said dome, said cavity being adapted for accumulating hydrocarbon fluid coming upwardly from the leaking device, said dome comprising at least one output opening adapted to extract the hydrocarbon fluid for recovering.

The containment system further comprises a lower output opening extending up to a dome level.

The wall and the dome of the containment system according to the invention are independent members so as the wall can be landed on the seafloor before the dome is installed.

Thanks to these features, the wall separates the fluid around the leaking device to the cold sea water. The fluids contained inside the wall volume around the leaking device is heated by the hydrocarbon fluid outputting from the leaking device, and is not cooled by the sea water.

Usually, cold water from seafloor is sucked up by the hydrocarbon fluid outputting from the leaking device at a high speed. This phenomenon generates a high convection movement between the cold sea water and the outputting hydrocarbon fluid. The wall of present invention cancels the horizontal movement of sea water at seafloor around the leaking device, and therefore cancels the sucking of cold water from sea by the outputting of hydrocarbon fluid from the leaking device. The wall therefore cancels the thermal convection exchange between the cold sea water and the hydrocarbon fluid.

Additionally, the wall cancels cold sea water to be sucked inside the dome cavity. The hydrocarbon fluid accumulated below the dome is therefore not cooled by sea water.

As, the wall can be easily installed around the leaking device before the dome, the sea water sucking can be cancelled before installing the dome above the wall. Thanks to the features of the proposed containment system, it can be easily installed around and above the leaking device without risking any hydraulic convection perturbations that may move the dome during installation.

As, the thermal exchanges between the sea water and the hydrocarbon fluid are then dramatically reduced by the containment system of present invention, and the hydrate formation is therefore prevented inside the cavity of the dome.

In various embodiments of the containment system, one and/or other of the following features may optionally be incorporated.

According to an aspect of the containment system, the dome further comprises a first injection device that inputs a first warm fluid into the cavity.

According to an aspect of the containment system, the first injection device comprises a plurality of output ports spread inside the cavity, said output ports being fed with the first warm fluid.

According to an aspect of the containment system, the containment system further comprises a pipe having an inner tube forming an inner channel, and an outer tube surrounding said inner tube and forming an annular channel, and wherein the inner channel is used to extract the hydrocarbon fluid from the upper output opening and the annular channel is used to feed the dome with at least a first warm fluid, or inversely.

According to an aspect of the containment system, the wall comprises a material that is a thermally isolating material.

According to an aspect of the containment system, the thermally isolating material has a thermal conductivity lower than 0.1 $W \cdot m^{-1} \cdot K^{-1}$.

According to an aspect of the containment system, the dome comprises a material that is a thermally isolating material.

According to an aspect of the containment system, the thermally isolating material has a thermal conductivity lower than 0.1 $W \cdot m^{-1} \cdot K^{-1}$.

According to an aspect of the containment system, the containment system further comprises at least one sensor for measuring an interface level of a fluid interface between sea water and hydrocarbon fluid inside the dome, at least one output valve connected to the upper output opening for outputting hydrocarbon fluid from the cavity, and a control unit for controlling said interface level on the bases of the interface level measured by the sensor.

According to an aspect of the containment system, the dome comprises:

a first output opening for extracting a first phase from the cavity, said first output opening being positioned on the dome at a level proximal to the first level, said first phase being for example an oil phase of the hydrocarbon fluid, and a second output opening for extracting a second phase from the cavity, said second output opening being positioned on the dome at a level proximal to a highest level of the dome, said second phase being lighter than the first phase, and being for example a gas phase of the hydrocarbon fluid.

According to an aspect of the containment system, the dome has an inner diameter greater to an outer diameter of the wall.

According to an aspect of the containment system, the dome level is lower than half the first level so as to form an annular cavity comprised between the wall and the dome, said dome level being preferably lower than one tenth of the first level, and more preferably lower than 1/20 of the first level.

According to an aspect of the containment system, the dome further comprises a second injection device that inputs a second warm fluid into the annular cavity comprised between the wall and the dome.

According to an aspect of the containment system, the second injection device comprises a plurality of output ports spread proximal to the peripheral lower end of the dome, said output ports being fed with the second warm fluid.

According to an aspect of the containment system, the dome comprises an upper portion extending in a radial direction from a centre vertical axis to an outer peripheral end, and a lateral portion extending the upper portion downwardly from said outer peripheral end at least down to the lower output opening.

According to an aspect of the containment system, the lateral portion comprises:

a lateral rigid structure extending from the upper portion to a lower end intended to be seated on the seafloor at the base level, said lateral rigid structure not closing the lateral portion, and an extendable device that is extendable from the upper portion to the lower output opening, so as to close partially the lateral portion of the dome.

According to an aspect of the containment system, the extendable device is a flexible member that is adapted to partially cover the lateral portion.

According to an aspect of the containment system, the flexible member is a thermally isolating material, having a thermal conductivity lower than 0.1 $W \cdot m^{-1} \cdot K^{-1}$.

According to an aspect of the containment system, the lateral rigid structure incorporates injection pipes so as to form a first injection device that inputs a first warm fluid into the cavity.

According to an aspect of the containment system, the lateral rigid structure is composed of a mesh of linked rigid beams, said rigid beam being formed of a structure material that is one of a list comprising a metal, a plastic, a material comprising fibres.

According to an aspect of the containment system, the dome is adapted to be sealed above the wall, and the lower output opening is an over pressure valve that extract fluid out from the cavity into environment if a pressure difference between the cavity and the environment exceeds a predetermined pressure limit.

According to an aspect of the containment system, the lower output opening is a ball check valve.

Another object of the invention is to provide a method for using a containment system for recovering hydrocarbon fluid from a leaking device that is situated at the seafloor and that is leaking hydrocarbon fluid from a well. The containment system comprises at least:

a wall extending from a base level to a first level, a dome forming a cavity under said dome, said cavity being adapted for accumulating hydrocarbon fluid coming upwardly from the leaking device, said dome comprising at least one output opening.

The containment system further comprises a lower output opening extending up to a dome level, and the wall and the dome are independent members.

The method comprises the following successive steps:

a) installing the wall around the leaking device on the seafloor, so as the base level corresponds to the seafloor, and said wall being substantially sealed to the seafloor around said leaking device, b) installing the dome above the wall, and c) connecting the upper output opening to a pipe for extracting the hydrocarbon fluid from the cavity.

Thanks to the above method, the wall is firstly installed to cancel the thermal convection exchanges between the cold sea water and the hydrocarbon fluid. Secondly, the dome can be landed on the seafloor and above the wall with no hydraulic perturbations, and without hydrate formation inside the cavity.

In preferred embodiments of the method proposed by the invention, one and/or the other of the following features may optionally be incorporated.

According to an aspect of the method, the dome further comprises a first injection device, and during the step b), the first injection device inputs a first warm fluid into the cavity.

According to an aspect of the method, the containment system further comprises at least one sensor, at least one output valve connected to the upper output opening, and a control unit, and the method further comprises the following steps:

the at least one sensor measures an interface level of a fluid interface between sea water and hydrocarbon fluid inside the dome, the control unit calculates a control value of the at least one output valve on the bases of said measured interface level, and controls said at least one output valve for outputting hydrocarbon fluid from the cavity.

According to an aspect of the method, the dome has an inner diameter greater to an outer diameter of the wall, and the dome comprises an upper portion extending in a radial direction from a centre vertical axis to an outer peripheral end, and a lateral portion extending the upper portion downwardly from the outer peripheral end at least down to the lower output opening.

According to an aspect of the method, the lateral portion is an extendable device, and wherein after step b) or step c), the extendable device is extended between the upper portion and the dome level.

According to an aspect of the method, the lower output opening is an over pressure valve that extract fluid out from the cavity into environment if a pressure difference between the cavity and the environment exceeds a predetermined pressure limit, and wherein after step b), the dome is sealed above the wall.

BRIEF DESCRIPTION OF THE DRAWINGS

Other features and advantages of the invention will be apparent from the following detailed description of at least one of its embodiments given by way of non-limiting example, with reference to the accompanying drawings. In the drawings.

DETAILED DESCRIPTION OF THE DRAWINGS

Figure 1:
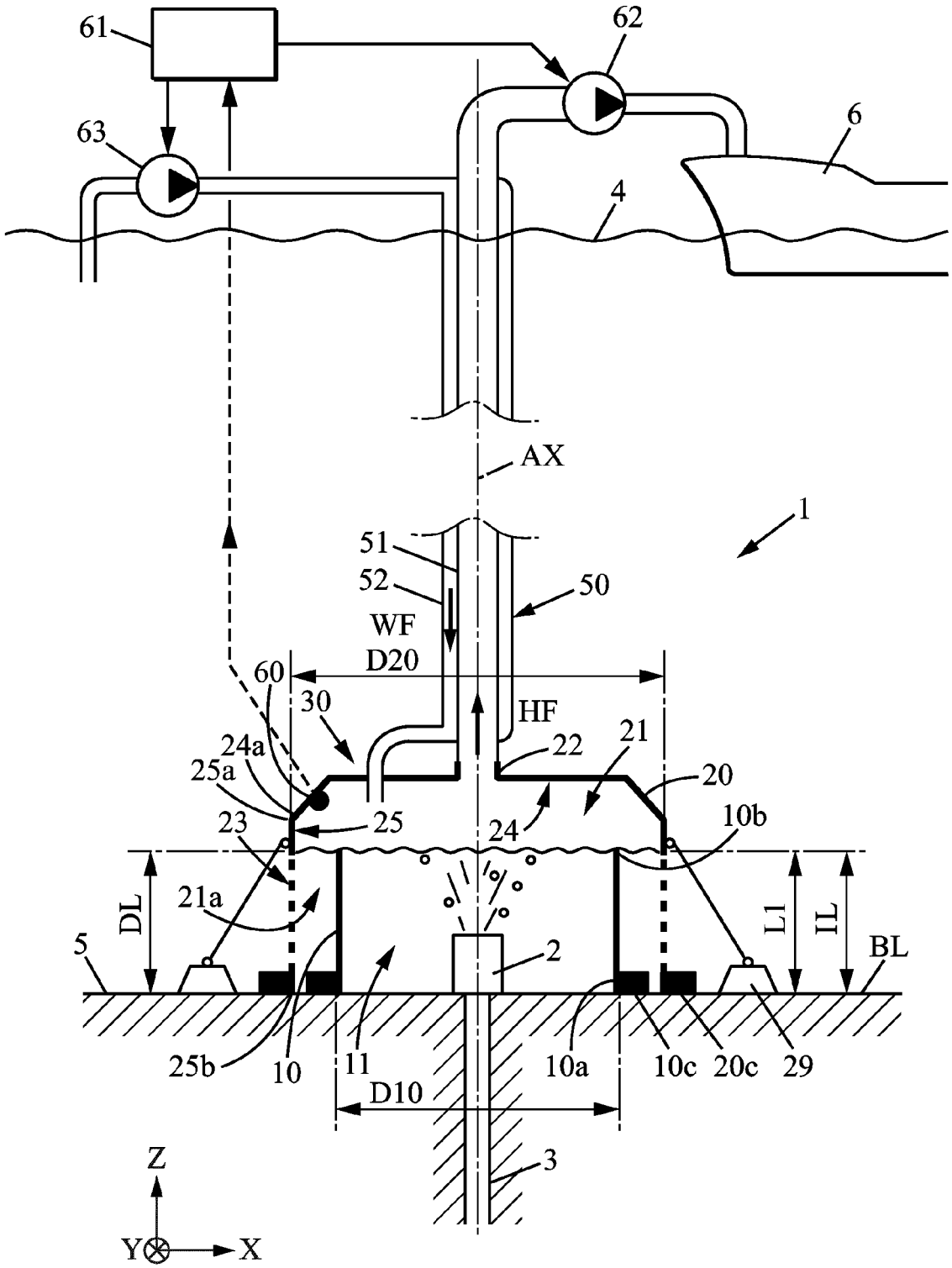
FIG. 1 is a schematic view of a vertical cut of a containment system according to a first embodiment of the invention.

In the various figures, the same reference numbers indicate identical or similar elements. The direction Z is a vertical direction. A direction X or Y is a horizontal or lateral direction. These are indications for the understanding of the invention.

As shown on all the embodiments of FIGS. 1 to 6, the containment system 1 of present invention is adapted for recovering hydrocarbon fluid from a leaking device 2 that is situated at a seafloor 5 of a deep offshore installation. The leaking device 2 is for example the well itself, a pipeline, a blow out preventer device, a wellhead or any device connected to the wellhead. The seafloor 5 is for example at more than 1500 meters deep below the sea surface 4. At this depth, the sea water is cold, for example around only 5° C. and at high pressure.

The hydrocarbon fluid may be liquid oil, natural gas, or a mix of them.

The leaking device 2 is leaking a hydrocarbon fluid from an subsea well 3. The hydrocarbon fluid exiting from the subsea may be rather hot, for example above 50° C. However, the environment cold temperature and high pressure may transform the sea water and hydrocarbon fluid into hydrates having a quasi-solid or solid phase. These hydrates can fill and clogged any cavity.

The containment system 1 of present invention is landed and fixed to the seafloor by any means, such as anchoring or heavy weights 29 for compensating the upward Archimedes force applied on the containment system 1 by the hydrocarbon fluid that is lighter than the sea water (lower mass density). The seafloor corresponds in the present description to a base level of the containment system 1. The other levels are defined going upwards, in the vertical direction Z towards the sea surface 4.

The containment system 1 of present invention comprises at least:

- a wall 10 extending from a lower end 10*a* at the base level to an upper end 10*b* at a first level L1, said wall 10 being substantially sealed to the seafloor around the leaking device 2, and
- a dome 20 situated above the wall 10 and forming a cavity 21 under said dome 20, said dome comprising at least an upper output opening (22).

The wall 10 and the dome 20 are preferably independent parts or members, each of them installed at the seafloor independently from the other, and each of them being fixed preferably to the seafloor. The wall 10 is installed on the seafloor before the dome 20, so as to cancel the convection of cold sea water before the installation of the dome 20.

For example, the wall 10 comprises foot 10*c* having heavy weights for sealing and securing the wall 10 to the seafloor. The dome 20 may have similarly foot 20*c* for securing it to the seafloor.

The wall 10 completely surrounds the leaking device 2. In a horizontal plane (XY), the wall 10 has a closed loop shape encompassing the leaking device 2. Said shape may be for example a circle shape, a square shape or any polygonal shape.

The wall 10 has an outer diameter D10. This outer diameter corresponds to a maximum distance between two external points of the wall, taken in an horizontal plane at a level near the first level L1. The outer diameter D10 is for example of 6 meters or more.

The wall 10 then extends upwardly from a lower end 10*a* at the base level BL to an upper end 10*b* at the first level L1. The first level L1 is preferably higher than a total height of the leaking device 2.

The wall 10 defines an inner wall volume 11. This volume 11 is substantially isolated (not in direct communication) with the environment sea water, according to a horizontal direction (XY). The volume 11 is opened upwardly, according to a vertical direction (Z). Such wall 10 cancels any horizontal flow of sea water that is usually sucked by the flow of hydrocarbon fluid outputting from the leaking device 2. This dramatically reduces the thermal convection exchange between the cold sea water and the hydrocarbon fluid. This first effect cancels the hydrate formation.

The first level L1 is preferably at least twice the total height of the leaking device 2, and more preferably three times higher than it. The wall 10 can cancel efficiently the convection effect of cold sea water.

The dome 20 is a hollow structure having:

- an upper portion 24 extending in a radial direction to an outer peripheral end 24*a*, said radial direction being perpendicular to the vertical direction AX, and
- a lateral portion 25 extending from the upper portion 24 downwardly between an upper end 25*a* and a lower end 25*b*, said lower end 25*b* comprising for example the foot 20*c*.

The lateral portion 25 has an inner diameter D20. This inner diameter D20 is wider than a total wide of the leaking device 2. For example, the inner diameter D20 is of 6 meters or more.

The lateral portion 25 of the dome is downwardly opened.

The dome 20 comprises an upper output opening 22 having of small diameter compared to the dome diameter. Said upper output opening is adapted to be connected to a pipe 50 for extracting the hydrocarbon fluid from the containment system 1 to a recovery boat 6 at the sea surface 4, so as the hydrocarbon fluid is recovered.

In the horizontal plane (XY), the dome may have advantageously the same shape as the wall 10.

In a vertical plane (XZ), the upper portion 24 of the dome 20 may have a convergent shape from the lateral portion 25 up to the upper output opening 22. The dome 20 is a cover that can have advantageously an inverted funnel shape.

The hollow structure of the dome 20 forms a largely opened cavity 21 in the direction to the seafloor. It is positioned above and around the wall 10. It is then above the leaking device 2 so as to accumulate the light hydrocarbon fluid.

The cavity 21 accumulates hydrocarbon fluid coming upwardly from the leaking device 2, i.e. oil and/or natural gas. The hydrocarbon fluid fills the upper volume of the cavity, down to an interface level IL.

The containment system 1 advantageously comprises at least one sensor 60 for measuring the interface level IL of the fluid interface between sea water and the hydrocarbon fluid inside the dome 20.

The sensor 60 may give a first measurement of a liquid level corresponding to the interface level IL between the liquid component of the hydrocarbon fluid (e.g. oil) and the sea water, and a second measurement of a gas level corresponding to an interface between the liquid component and a gas component (e.g. natural gas) of the hydrocarbon fluid.

The containment system 1 additionally comprise an output valve 62 connected to the upper output opening 22 and/or pipe 50 for outputting the recovered hydrocarbon fluid to the recovery boat 6.

Then, a control unit 61 calculates a control value on the basis of a measured value of the interface level IL, and operates the output valve on the bases of the control value for outputting hydrocarbon fluid from the cavity. The control unit 61 may calculate the control value to keep the interface level at a constant level inside the cavity 21.

The containment system 1 may also comprise a first injection device 30 that injects a first warm fluid (WF) into the cavity 21. Therefore, the hydrocarbon fluid can be heated, and prevented to form hydrates.

The first injection device 30 may comprise a plurality of output ports spread inside the volume of the cavity, so as to ensure a constant warming of the hydrocarbon fluid inside the cavity 21.

The first injection device 30 may injects the first warm fluid WF from the upper portion 24, the lateral portion 25 or from both portions 24, 25 of the dome 20.

The first warm fluid WF may be sea water pumped near the sea surface 4 via a pump 63. The pumped sea water may be used as it, i.e. at the temperature of sea water at the sea surface 4, or heated by additional means.

The first warm fluid may be water, oil, gas oil, or crude oil or any heat transfer fluid. The first warm fluid may be additionally heated or not.

The pipe 50 is advantageously a two concentric tubes pipe, having an inner pipe 51 forming an inner channel, and an outer tube 52 surrounding said inner pipe 51 and forming an annular channel between the inner tube and the outer tube. The inner channel may be connected to the upper output opening 22 and used to extract the hydrocarbon fluid from the cavity 21. The annular channel may be therefore connected to the first injection system 30, and used to feed it with the first warm fluid from the surface. However, it is apparent that the two channel of such pipe can be connected to the dome according to the other inverse possibility without any change.

The containment system 1 may comprise other output openings and/or pipes for feeding additionally fluids, or for extracting other fluids, liquid or gases from the cavity.

For example, the containment system 1 may comprise a drain valve for purging or limiting the quantity of water inside the cavity 21. Said drain valve might be positioned proximal to the base level BL (seafloor).

Advantageously, the cavity 21 can be used as a phase separator for separating the water and the hydrocarbon fluid, and for separating each phase of the hydrocarbon fluid (oil, gas) so as to extract them separately.

To this end, the dome 20 may comprise:

- a first output opening for extracting a first phase from the cavity, said first output opening being positioned on the dome at a level proximal to the first level L1, said first phase being for example an oil phase of the hydrocarbon fluid, and
- a second output opening for extracting a second phase from the cavity, said second output opening being positioned on the dome at a level proximal to a highest level of the dome, said second phase being lighter than the first phase, and being for example a gas phase of the hydrocarbon fluid.

Thanks to the above first and second output opening, quantities of each phase (oil, gas) can be limited inside the cavity 21 to predetermined values. An Archimedes force maximum that applies on the containment system 1 can be predetermined, and the weights of the foot 20*c* can therefore be predetermined for maintaining the containment system 1 landed at the seafloor 5.

The upper portion 24 of the dome 20 may comprise output openings, called vents, for evacuating large quantities of fluid inside the cavity 21. These vents are helpful to facilitate the installation of the containment system 1 above the leaking device 2. The vents are opened during the first transient steps of installation, noticeably when the containment system 1 is made to go down to the seafloor 5 around the leaking device 2. During these steps all the hydrocarbon fluid may be evacuated to cancel its Archimedes force on the containment system and to prevent hydrates formation problem.

Moreover, the dome 20 may comprises upper and lateral portions 24, 25 that comprise thermal isolating material, so as to thermally isolate the cavity 21 from the cold environment of sea water. Ideally, the thermally isolating material has a thermal conductivity lower than 0.1 $W \cdot m^{-1} \cdot K^{-1}$.

The following thermal isolation materials may be used: synthetic material such as Polyurethane (PU) or polystyrene material, or a fibre textile with Polyvinyl chloride (PVC) coating or PU coating, or Alcryn®. The thermal isolation material may be foam, or a gel contained inside a double wall structure.

The wall 10 and dome 20 may comprise a plurality of walls, layers or envelopes for improving the thermal isolation. Between the layers, isolation materials may be included, or heating devices (electric, hydraulic or of any kind) to improve again the thermal isolation of the wall and/or dome.

The thermal isolation of the dome 20 passively isolates the cavity 21, while the first injection device 30 actively isolates the cavity 21. Both effects prevent the formation of hydrates inside the cavity 21.

Additionally, the wall 10 may also comprise thermal isolating material to thermally isolate the wall volume 11 from the cold sea water. Ideally, the thermally isolating material has a thermal conductivity lower than 0.1 $W \cdot m^{-1} \cdot K^{-1}$.

The same thermal isolation materials compared to those for the dome may be used.

The wall 10 cancels the thermal convection exchange between the cold sea water and the hydrocarbon fluid and reduces a lot the thermal conduction exchange between the cold sea water and the hydrocarbon fluid, therefore preventing the formation of hydrates.

In the case of the embodiments of FIGS. 1 to 5 (first to forth embodiments), the inner diameter D20 of the dome is then greater than an outer diameter D10 of the wall. The dome 20 can surround the wall 10.

The dome 20 further comprises a lower output opening 23 that is situated on the lateral portion 25 and that extends up to a dome level DL. The dome level DL is preferably lower or equal to the first level L1.

The lower output opening 23 communicates with the environment sea water and is adapted to equal a cavity pressure of the cavity 21 to an environment pressure at the seafloor.

The lower output opening 23 additionally limits the level of hydrocarbon fluid inside the cavity 21.

An interface between the environment sea water and the hydrocarbon fluid accumulated inside the dome cavity is an annular surface situated between the upper end 10*b* of the wall 10 and the lateral portion 25 of the dome 20. The annular surface presents a much reduced area. Thanks to this feature, the thermal conduction exchange between the cold sea water and the hydrocarbon fluid contained inside the cavity is reduced. The hydrocarbon fluid contained inside the dome cavity is not cooled by the sea water of said annular surface. And, the hydrates formation is prevented.

In the case of the first embodiment of FIG. 1, the dome level DL of the lower output opening 23 is equal to the first level L1 of the upper end 10*b* of the wall 10.

The hydrocarbon fluid accumulates inside the cavity 21 from the upper output opening 22 down to said dome level DL. In this case, the dome 20 can be filled with hydrocarbon only down to the first level L1 (then equal to the interface level IL) as represented on FIG. 1.

The interface level IL may be higher than the first level L1, depending on the flow of hydrocarbon fluid exiting from the leaking device 2 and the flow of hydrocarbon fluid exiting from the cavity by the upper output opening 22.

The cavity 21 is a volume storing a quantity of hydrocarbon fluid and absorbing the fluctuations of flows.

Figure 2:
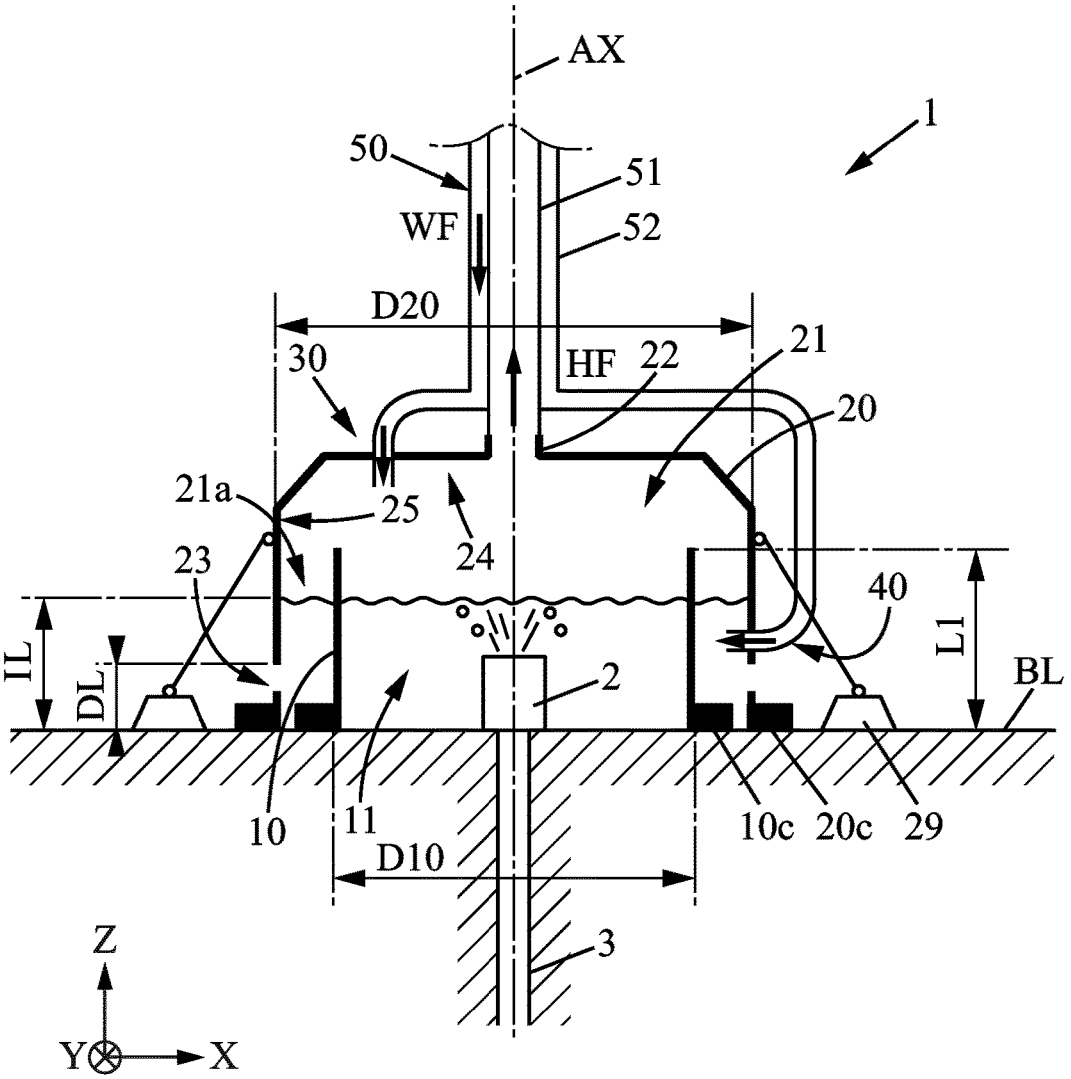
FIG. 2 is a schematic view of a vertical cut of a containment system according to a second embodiment of the invention.

According to the second embodiment of FIG. 2, the dome level DL is lower than the first level L1: Then, the lower output opening 23 is lower than the first level L1.

This feature increases the fluid path between the leaking device 2 and the sea water. The wall 10 and the lateral portion 25 of the dome 20 form a chicane path. The volume between the wall 10 and the lateral portion 25 of the dome 20 is an annular cavity 21*a*, that surrounds the wall 10. The fluid interface (hydrocarbon fluid—sea water) inside the annular cavity 21*a* is the only direct interface between the cold sea water and the hydrocarbon fluid. This interface is an annular surface having a much reduced area. The conduction exchange is therefore highly decreased. The formation of hydrates is more prevented.

The cavity 21 and the annular cavity 21*a* are volumes storing a quantity of hydrocarbon fluid and absorbing the fluctuations of flows form the leaking device 2.

However, if the interface only moves inside the annular cavity 21*a*, no cold sea water can enter inside the cavity 21 above the leaking device 2. The volume of the annular cavity 21*a* is then preferred for compensating the fluctuations of flows from the leaking device 2.

Thanks to said annular volume 21*a*, the interface keeps a reduced area. The hydrocarbon fluid contained inside the dome cavity is not cooled by the environment sea water. And, the hydrates formation is prevented.

Advantageously, the lower output opening 23 is proximal to the base level BL. For example, the dome level DL is lower than half the first level L1.

More advantageously, the dome level DL is lower than one tenth the first level L1.

More advantageously, the dome level DL is lower than 1/20 of the first level L1.

Thanks to the above features, the lower output opening 23 is proximal to the seafloor 5.

The annular cavity 21*a* has a bigger volume. The flows fluctuations can be most likely be compensated.

The cavity 21 is more isolated from the sea water: the thermal exchanges between the sea water and the hydrocarbon fluid inside the cavity 21 are more and more reduced. The formation of hydrates is more prevented.

The dome 20 may further comprises a second injection device 40 that inputs a second warm fluid into the annular cavity 21*a*.

The second warm fluid may be identical to the first warm fluid.

The second warm fluid also prevents the hydrates formation from the lower output opening 23.

Figure 3:
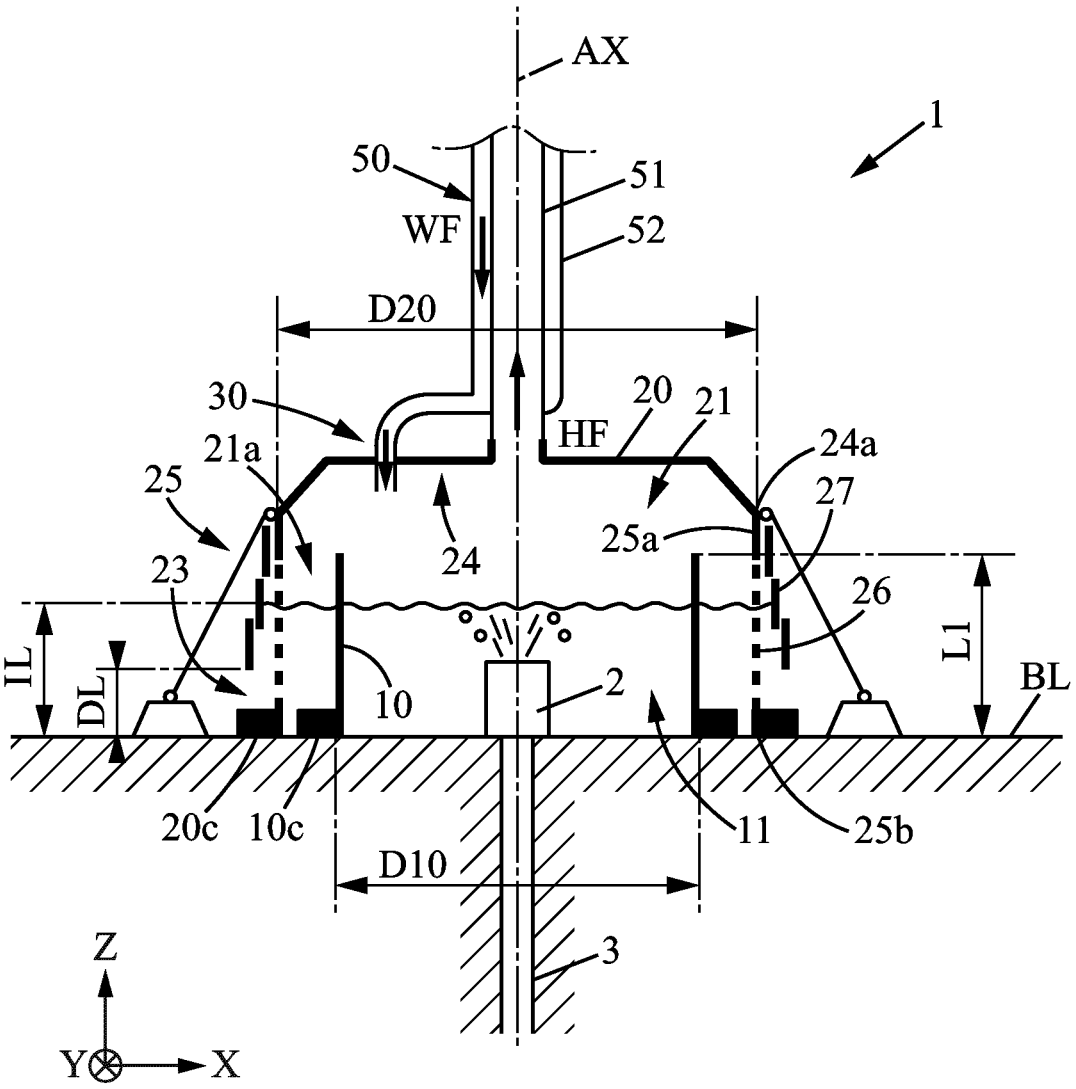
FIG. 3 is a schematic view of a vertical cut of a containment system according to a third embodiment of the invention.
Figure 4:
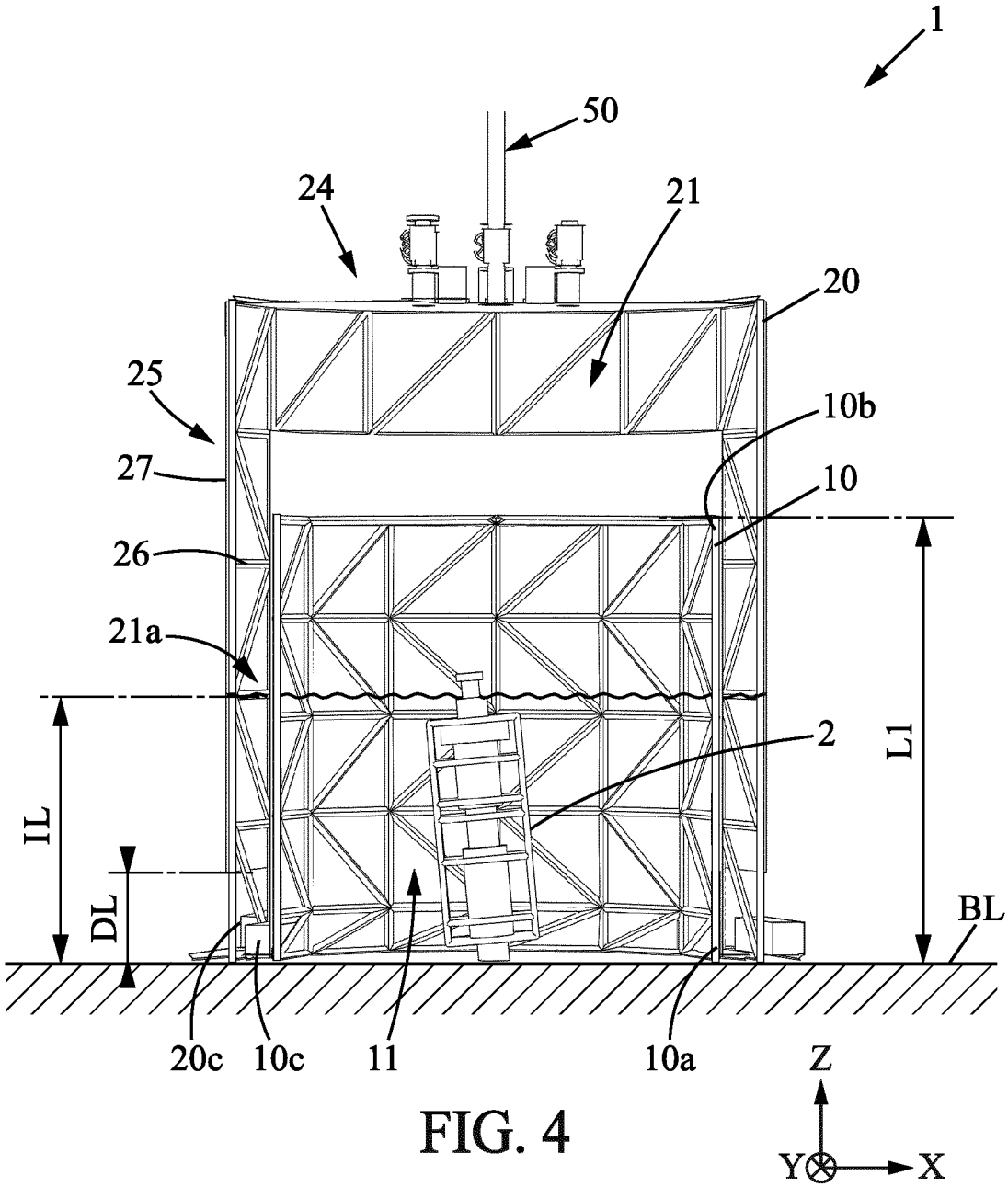
FIG. 4 is a schematic view of a vertical cut of a containment system according to a forth embodiment of the invention.

The third embodiment of FIG. 3 is similar to the second embodiment of FIG. 2: the dome level DL is lower than the first level L1. However, this dome level DL is obtained progressively after the installation of the dome 20 on the seafloor 5.

The lateral portion 25 of the dome 20 comprises an extendable device 27 that can progressively cover and closes a rigid structure 26 that is not closing the lateral portion for the sea water.

The rigid structure 26 extends from the upper portion 24 to a lower end seated on the seafloor 5 (base level BL).

The extendable device 27 extends from the upper portion 24 to the lower output opening 23, or inversely. It keep the lower output opening 23 opened, and partially closes the lateral portion 25 so as to form the annular cavity 21*a* around the wall 10, as for the static second embodiment of FIG. 2.

The extendable device 27 may be composed of a plurality of deployable elements that form a telescopic device, or may be composed of a flexible member.

The extendable device 27 may be composed of at least a thermally isolating material.

The isolating material may be a synthetic material such as Polyurethane (PU) or polystyrene material, or a fibre textile with Polyvinyl chloride (PVC) coating or PU coating, or Alcryn®.

For example, a extendable device 27 that is flexible, may be composed of a cover, a multilayer cover, a heated cover, an electrically heated cover, or a cover comprising a sealed isolating gel.

The thermal resistivity of the extendable device may be the same as the one of the dome as disclosed above.

The FIG. 4 and FIG. 5*a* to 5*e* represent views of a containment system 1 designed according to the forth embodiment that is very similar to the third embodiment (FIG. 3). The forth embodiment uses a extendable device 27 that is a flexible member.

In these figure, a particular lateral rigid structure 26 is visible. Said lateral rigid structure 26 is composed of a mesh of linked rigid beams. These beams may be manufactured with a structure material such as metal, plastic, or a synthetic material comprising reinforcing fiber, such as carbon fiber.

Additionally, the lateral rigid structure 26 may incorporate injection pipes or by composed of pipes used as injection pipes so as to provide the first injection device 30, for injecting the first warm fluid inside the cavity 21.

The extendable device 27 in these figures is a flexible member that is progressively deployed from the upper portion 24 of the dome 20.

In the embodiment of these figures, the wall 10 is also composed of at least a rigid structure and a flexible member progressively deployed from the upper end 10*b* of the wall, as soon as the wall 10 is installed on seafloor around the leaking device 2.

The FIG. 5*a* to 5*e* are more specifically illustrating the method for using or installing the containment system 1 according to the invention.

Figure 5C:
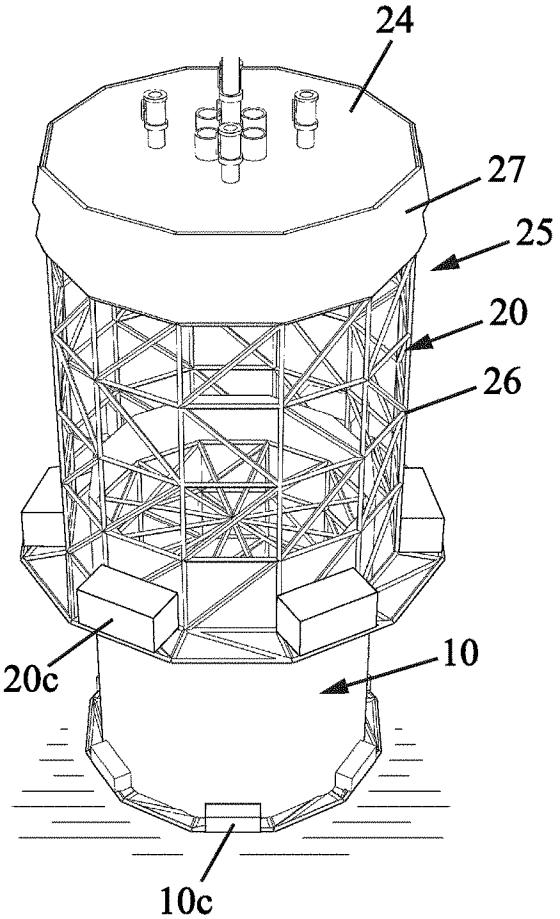
FIGS. 5*a* to 5*e* are perspective views of a method for using the containment system, said method being illustrated by viewing the installation steps of the containment system of FIG. 4.
Figure 5B:
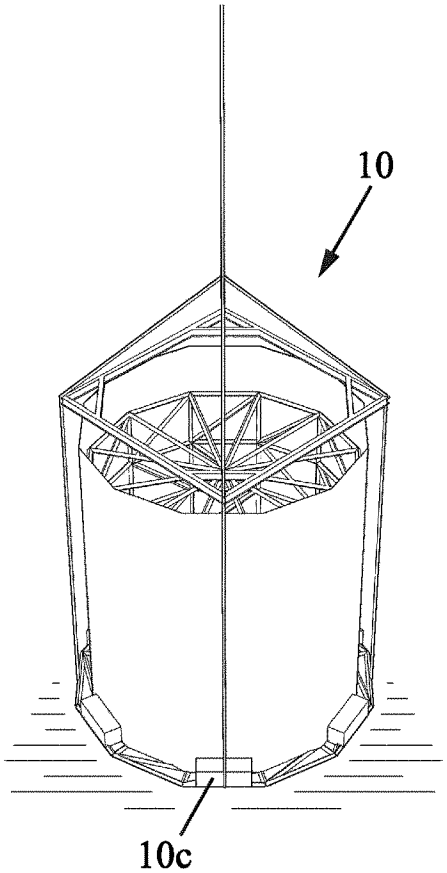
Figure 5A:
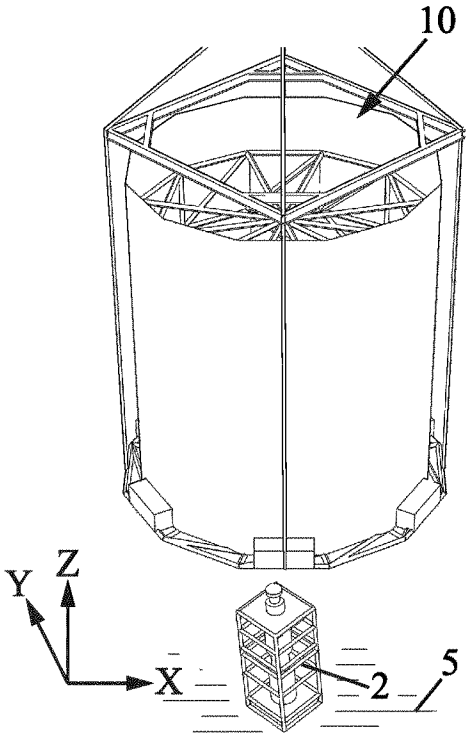

On FIG. 5*a*, the wall 10 is made to go down to the seafloor 5 around the leaking device 2, by a first descent tool.

On FIG. 5*b*, the wall 10 is landed on seafloor 5. The lower end 10*a* of the wall 10 is eventually sealed to the seafloor by any means. The wall 10 may be fixed to the seafloor only by the weights of the foot 10*c* or by other fixation means.

On FIG. 5*c*, the dome 20 is made to go down to the seafloor 5 around the wall 10. It may be guided by the wall itself already fixed to the seafloor.

Figure 5E:
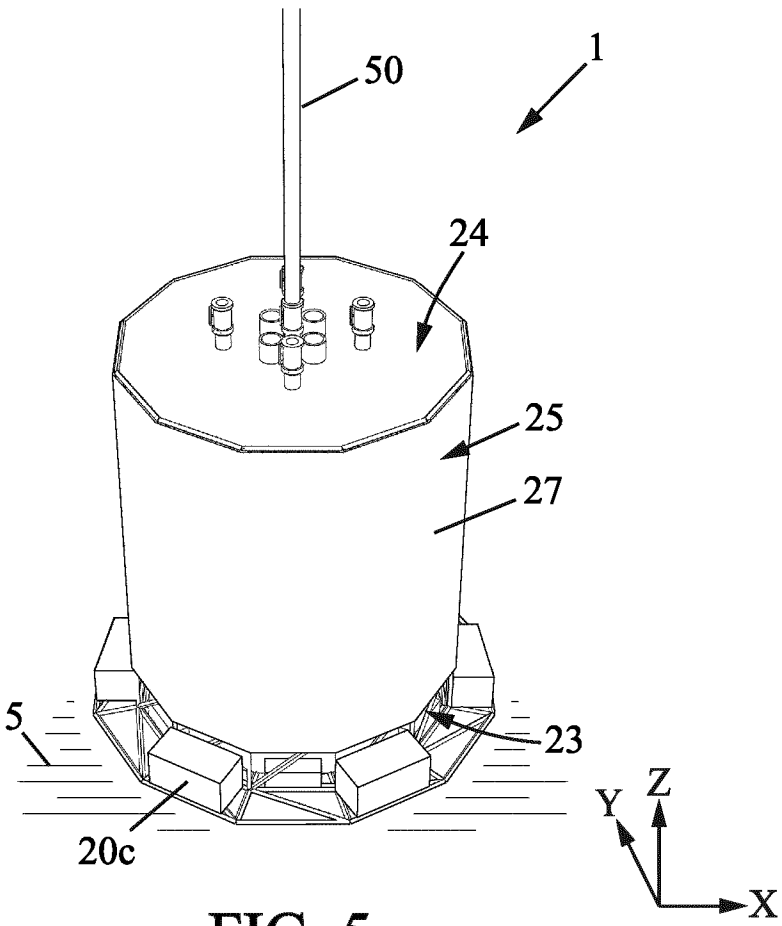
Figure 5D:
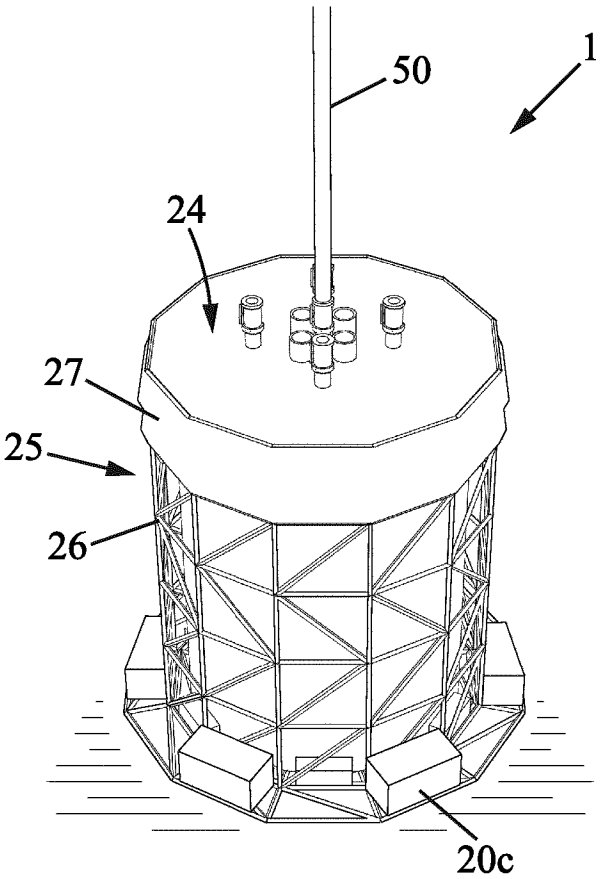

On FIG. 5*d*, the dome 20 is landed on seafloor 5, and can be additionally fixed to the seafloor 5 if the weights of the foot 20*c* are not enough.

On FIG. 5*e*, the flexible extendable device 27 is deployed on the rigid structure 26 from the upper portion 24 of the dome 20 to form the lower output opening 23.

During the steps of FIG. 5*c* to 5*e*, the injection device 30 may injects a warm fluid into the cavity 21. Events above the upper portion 24 may also be opened for facilitating the installation of the dome 20.

The method will be again explained below, in view of all the embodiments of the invention.

Figure 6:
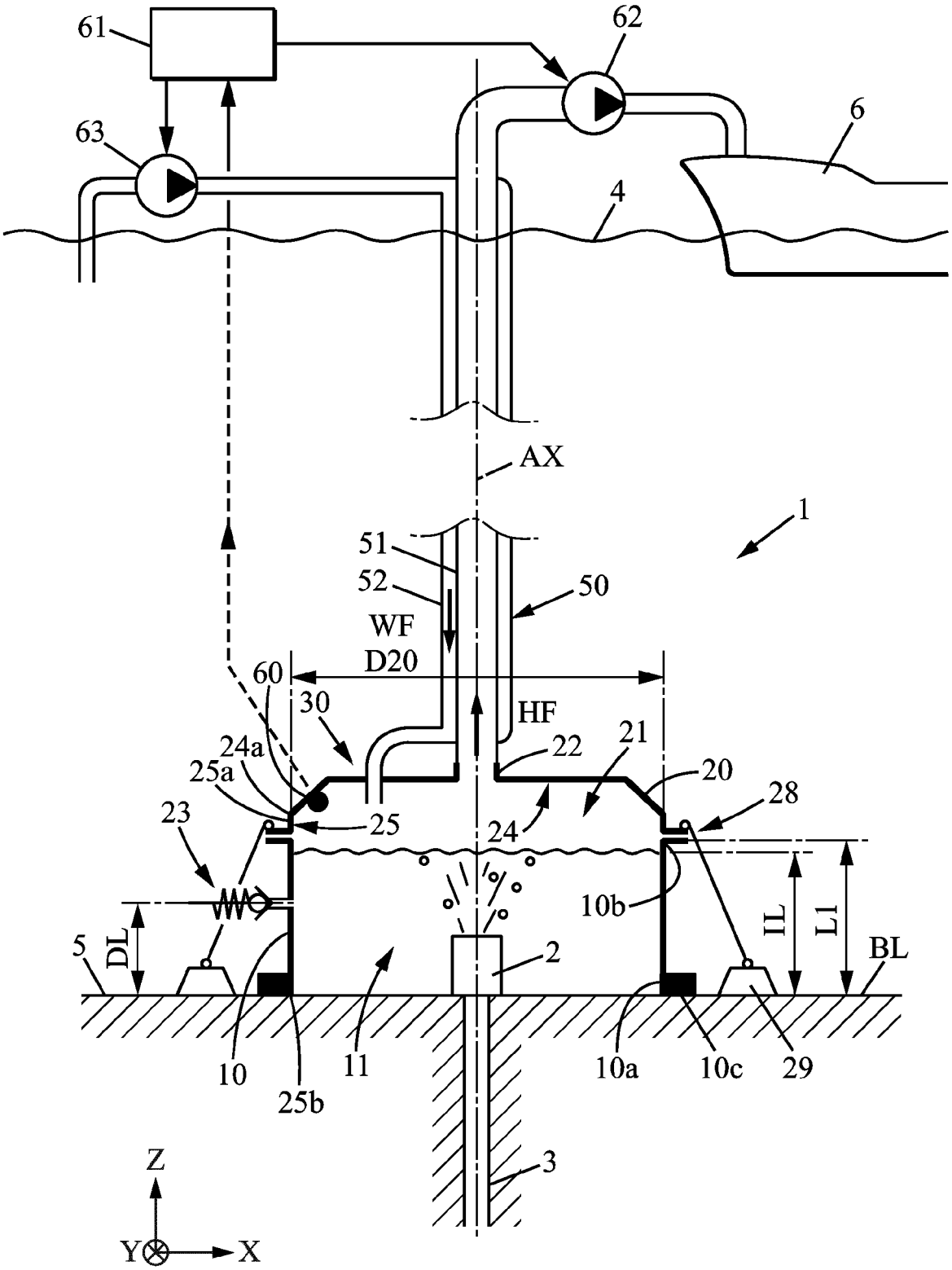
FIG. 6 is a schematic view of a vertical cut of a containment system according to a fifth embodiment of the invention.

FIG. 6 is presenting a fifth embodiment of the invention. According to the fifth embodiment, the inner diameter D20 of the dome is substantially equal to the outer diameter D10 of the wall. In fact both elements may have similar diameter.

The dome 20 is sealed and fixed to the upper end 10*b* of the wall 10, for example by a corresponding collars or flanges 28 extending radially from each.

The wall 10 comprises the lower output opening 23. Said lower output opening 23 comprises an over pressure valve that extract fluid out of the cavity and into the environment if a pressure difference between the cavity 21 and the environment exceeds a predetermined pressure limit.

The predetermined pressure limit is for example of 10 bars, 20 bars, or 50 bars. This limit has to be determined accordingly with the cavity size and the leaking device flow.

The over pressure valve is for example a ball check valve. The ball check valve comprises a support element, a ball, and a spring that loads the ball to the support element so as to close an opening. The tuning of the spring load is adapted to the predetermined pressure limit.

Advantageously, the dome 20 of present embodiment is fed with warm fluid during the sealing and fixing step of the dome 20 above the wall 10, so as hydrates formation is prevented.

The cavity 21 is closed, and the fluid inside the cavity is rapidly heated by the hydrocarbon fluid itself outputting from the leaking device 2.

The over pressure valve 23 insures that the pressure inside the cavity is not increasing, and then insuring that the containment system is not destroyed. Moreover, the predetermined pressure limit may insure that hydrates formation is prevented.

The fifth embodiment is advantageously having a control of the interface level IL as explained above.

The method for using or installing the containment system 1 according to the invention is now explained. The method comprises the following successive steps:

a) installing the wall 10 around the leaking device on the seafloor, so as the base level corresponds to the seafloor, and said wall being substantially sealed to the seafloor around said leaking device, b) installing the dome 20 above the wall, c) connecting the upper output opening 22 to a pipe 50 for extracting the hydrocarbon fluid from the cavity 21.

Thanks to the above method, the thermal convection exchanges between the cold sea water and the hydrocarbon fluid is reduced even if the wall is opened upwardly.

The wall 10 cancels lateral movement of cold sea water at the seafloor around the leaking device 2. The sucking of cold sea water is cancelled or dramatically reduced.

The volume of fluid above the leaking device 2 inside the wall cavity 11 is rapidly heated by the hydrocarbon fluid itself.

As soon as the hydraulic and thermal conditions are steady around the leaking device 2 thanks to the previous installation of the wall 10, the dome 20 can be installed above the wall 10.

The dome can be landed on the seafloor and above the wall with no hydraulic perturbations, and without hydrate formation inside the cavity 21.

In case of first to forth embodiments, the dome is landed around the wall 10 therefore forming an annular cavity 21 that is useful to compensate the fluctuations of flow from the leaking device 2.

In case of fifth embodiment, the over pressure valve embedded inside the lower output opening 23 ensures that pressure inside the cavity 21 is not increasing.

The dome 20 may further comprise a first injection device 30, and during the step b) of the method, the first injection device 30 injects a first warm fluid WF into the cavity 21, to prevent the hydrates formation.

In case of the third and forth embodiment, after step b) or step c) of the method, the extendable device 27 is extended between the upper portion 24 and the dome level DL.

The embodiments above are intended to be illustrative and not limiting. Additional embodiments may be within the claims. Although the present invention has been described with reference to particular embodiments, workers skilled in the art will recognize that changes may be made in form and detail without departing from the spirit and scope of the invention.

Various modifications to the invention may be apparent to one of skill in the art upon reading this disclosure. For example, persons of ordinary skill in the relevant art will recognize that the various features described for the different embodiments of the invention can be suitably combined, un-combined, and re-combined with other features, alone, or in different combinations, within the spirit of the invention. Likewise, the various features described above should all be regarded as example embodiments, rather than limitations to the scope or spirit of the invention. Therefore, the above is not contemplated to limit the scope of the present invention.

The invention claimed is:

1. A containment system for recovering hydrocarbon fluid from a leaking device that is situated at the seafloor and that is leaking hydrocarbon fluid from a well, wherein the containment system is adapted to be landed at the seafloor corresponding to a base level of the containment system, and wherein the containment system comprises at least:

a wall extending from the base level to a first level so as to completely surround the leaking device, said wall being substantially sealed to the seafloor around said leaking device, and a dome situated above the wall and forming a cavity under said dome, said cavity being adapted for accumulating hydrocarbon fluid coming upwardly from the leaking device, said dome comprising at least one upper output opening adapted to extract the hydrocarbon fluid for recovering, and wherein the containment system further comprises a lower output opening extending up to a dome level, and wherein the wall and the dome are independent members so the wall can be landed on the seafloor before the dome is installed, and wherein the dome comprises an upper portion extending in a radial direction from a centre vertical axis to an outer peripheral end, and a lateral portion extending the upper portion downwardly from said outer peripheral end at least down to the lower output opening, and wherein the lateral portion comprises:

a lateral rigid structure extending from the upper portion to a lower end intended to be seated on the seafloor at the base level, said lateral rigid structure not closing the lateral portion, and an extendable device that is extendable from the upper portion to the lower output opening, so as to close partially the lateral portion of the dome.

2. The containment system according to claim 1, wherein the dome further comprises a first injection device that inputs a first warm fluid into the cavity.

3. The containment system according to claim 2, wherein the first injection device comprises a plurality of output ports spread inside the cavity, said output ports being fed with the first warm fluid.

4. The containment system according to claim 2, further comprising a pipe having an inner tube forming an inner channel, and an outer tube surrounding said inner tube and forming an annular channel, and wherein the inner channel is used to extract the hydrocarbon fluid from the upper output opening and the annular channel is used to feed the dome with at least a first warm fluid, or inversely.

5. The containment system according to claim 1, wherein the wall comprises a material that is a thermally isolating material.

6. The containment system according to claim 5, wherein the thermally isolating material has a thermal conductivity lower than 0.1 $W \cdot m^{-1} \cdot K^{-1}$.

7. The containment system according to claim 1, wherein the dome comprises a material that is a thermally isolating material.

8. The containment system according to claim 7, wherein the thermally isolating material has a thermal conductivity lower than 0.1 $W \cdot m^{-1} \cdot K^{-1}$.

9. The containment system according to claim 1, further comprising at least one sensor for measuring an interface level of a fluid interface between sea water and hydrocarbon fluid inside the dome, at least one output valve connected to the upper output opening for outputting hydrocarbon fluid from the cavity, and a control unit for controlling said interface level on the bases of the interface level measured by the sensor.

10. The containment system according to claim 1, wherein the dome comprises:

a first output opening for extracting a first phase from the cavity, said first output opening being positioned on the dome at a level proximal to the first level, said first phase being for example an oil phase of the hydrocarbon fluid, and a second output opening for extracting a second phase from the cavity , said second output opening being positioned on the dome at a level proximal to a highest level of the dome, said second phase being lighter than the first phase, and being for example a gas phase of the hydrocarbon fluid.

11. The containment system according to claim 1, wherein the dome has an inner diameter greater than an outer diameter of the wall.

12. The containment system according to claim 11, wherein the dome level is lower than half the first level so as to form an annular cavity comprised between the wall and the dome.

13. The containment system according to claim 12, wherein the dome further comprises a second injection device that inputs a second warm fluid into the annular cavity comprised between the wall and the dome.

14. The containment system according to claim 13, wherein the second injection device comprises a plurality of output ports spread proximal to the peripheral lower end of the dome, said output ports being fed with the second warm fluid.

15. The containment system according to claim 12, wherein the dome level is lower than one tenth of the first level.

16. The containment system according to claim 12, wherein the dome level is lower than 1/20 of the first level.

17. The containment system according to claim 1, wherein the extendable device is a flexible member that is adapted to partially cover the lateral portion.

18. The containment system according to claim 17, wherein the flexible member is a thermally isolating material, having a thermal conductivity lower than 0.1 $W \cdot m^{-1} \cdot K^{-1}$.

19. The containment system according to claim 17, wherein the lateral rigid structure incorporates injection pipes so as to form a first injection device that inputs a first warm fluid into the cavity.

20. The containment system according to claim 17 wherein the lateral rigid structure is composed of a mesh of linked rigid beams, said rigid beam being formed of a structure material that is one of a list comprising a metal, a plastic, a material comprising fibres.

21. The containment system according to claim 1, wherein the dome is adapted to be sealed above the wall, and the lower output opening is an over pressure valve that extract fluid out from the cavity into environment if a pressure difference between the cavity and the environment exceeds a predetermined pressure limit.

22. The containment system according to claim 21, wherein the lower output opening is a ball check valve.

23. A method for using a containment system for recovering hydrocarbon fluid from a leaking device that is situated at the seafloor and that is leaking hydrocarbon fluid from a well, and wherein the containment system comprises at least:

a wall extending from a base level to a first level, a dome forming a cavity under said dome, said cavity being adapted for accumulating hydrocarbon fluid coming upwardly from the leaking device, said dome comprising at least one upper output opening, and wherein the wall further comprises a lower output opening, and wherein the wall and the dome are independent members, and wherein the method comprises the following successive steps:

a) installing the wall around the leaking device on the seafloor, so as the base level corresponds to the seafloor, and said wall being substantially sealed to the seafloor around said leaking device, b) installing the dome above the wall, c) connecting the upper output opening to a pipe for extracting the hydrocarbon fluid from the cavity, and wherein the lower output opening is an over pressure valve that extracts fluid out from the cavity into an environment if a pressure difference between the cavity and the environment exceeds a predetermined pressure limit, and wherein after step b), the dome is sealed above the wall.

24. The method according to claim 23, wherein the dome further comprises a first injection device, and at least during the step b), the first injection device inputs a first warm fluid into the cavity.

25. The method according to claim 23, wherein the containment system further comprises at least one sensor, at least one output valve connected to the upper output opening, and a control unit, and wherein the method further comprises the following steps:

the at least one sensor measures an interface level of a fluid interface between sea water and hydrocarbon fluid inside the dome, the control unit calculates a control value of the at least one output valve on the bases of said measured interface level, and controls said at least one output valve for outputting hydrocarbon fluid from the cavity.

26. The method according to claim 23, wherein the dome has an inner diameter greater than an outer diameter of the wall, and the dome comprises an upper portion extending in a radial direction from a centre vertical axis to an outer peripheral end, and a lateral portion extending the upper portion downwardly from the outer peripheral end at least down to the lower output opening.

27. The method according to claim 26, wherein the lateral portion is an extendable device, and wherein after step b) or step c), the extendable device is extended between the upper portion and the dome level.

* * * * *